United States Patent [19]

Ruschitzka

[11] 4,379,430

[45] Apr. 12, 1983

[54] CLAMP-BOLT SHELVING

[76] Inventor: Friedrich Ruschitzka, Im Bruhl (ohne Nummer), 6921 Zuzenhausen, Fed. Rep. of Germany

[21] Appl. No.: 153,327

[22] Filed: May 27, 1980

[30] Foreign Application Priority Data

Jun. 7, 1979 [DE] Fed. Rep. of Germany ... 7916400[U]
Apr. 26, 1980 [DE] Fed. Rep. of Germany ..... 3016218

[51] Int. Cl.[3] ..... A47B 9/00

[52] U.S. Cl. ..... 108/107; 211/190; 211/192; 108/110

[58] Field of Search ..... 108/107, 110, 108, 109; 248/243; 211/190, 191, 192, 193

[56] References Cited

U.S. PATENT DOCUMENTS

| | | | |
|---|---|---|---|
| 1,411,260 | 4/1922 | Baker et al. | 108/107 |
| 1,750,696 | 3/1930 | Vance | 108/107 |
| 3,106,297 | 10/1963 | Schroeder | 211/192 |
| 3,503,524 | 3/1970 | Kaummell et al. | 211/193 |
| 3,522,920 | 8/1970 | Gray et al. | 108/107 X |
| 3,592,345 | 7/1971 | Featherman | 108/107 X |
| 3,726,413 | 4/1973 | Squires | 108/107 |

FOREIGN PATENT DOCUMENTS

| | | | |
|---|---|---|---|
| 7711976 | 11/1977 | Netherlands | 108/107 |

*Primary Examiner*—Francis K. Zugel
*Assistant Examiner*—Peter A. Aschenbrenner
*Attorney, Agent, or Firm*—Staas & Halsey

[57] ABSTRACT

Shelving wherein bores are drilled in legs of channel-section-shaped shelving posts, between the legs of which is positioned channel-section-shaped crosspiece having obliquely downwardly and upwardly extending slotted crosspiece holes lying opposite the bores, and wherein a clamp bolt is placed in the bores in the slotted crosspiece holes, the bores and slotted crosspiece holes lying opposite one another.

15 Claims, 24 Drawing Figures

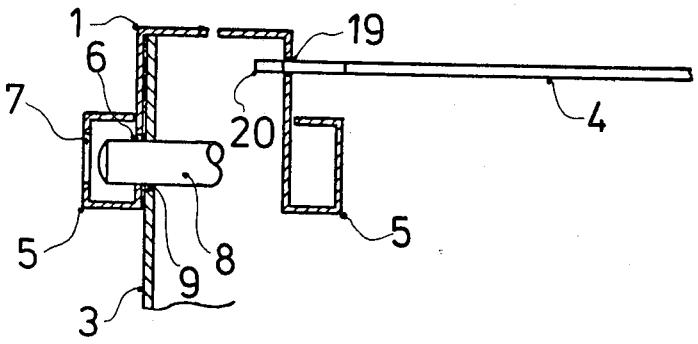
Fig.10
Fig. 11
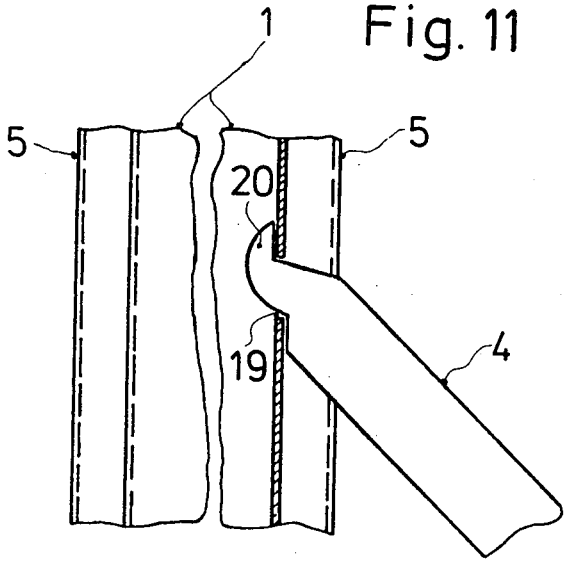

CLAMP-BOLT SHELVING

BACKGROUND OF THE INVENTION

The invention relates to a shelving consisting essentially of shelving post, crosspiece, shelving base, and clamp bolt, and which can be completed as required with accessories that are known today.

SUMMARY OF THE INVENTION

The object of such a shelving made up of individual shelving posts, individual crosspieces, individual shelving bases, and individual clamp bolts is to provide the final consumer with a shelving built according to the unit construction system and which can easily be sold. Thus, the final consumer can install the shelving himself on the desired spot after purchasing only as many component parts as he needs.

Shelvings are known in which shelves are hung between two opposite ladder-type supporting structures. The individual shelving base has suspension hooks along its sides, by means of which it is hung on a particular rung of the ladder-type supporting structure. Cross braces are absolutely necessary to stabilize such a shelving, since this shelving can have no lateral stability. Another form of shelving in the unit construction system consists of profile ribs which are mounted on a fixed wall. In these profile ribs are suspended brackets over which the shelves are laid. It goes without saying that this type of shelving is not self-supporting. Whereas shelvings built with the aid of ladder-type supporting structures can have no lateral stability, shelvings anchored in a fixed wall, aside from the fact that they are not self-supporting, are unsuited for heavy loads. Moreover, both types of shelving need to be set up with precision; this cannot be done without special tools, unless one accepts a very unstable shelving.

The object of the invention is to provide a self-supporting shelving in accordance with the unit construction system, which can be set up by anybody without special tools, is stable in all directions, and is capable of taking heavy loads.

In accordance with the invention, this problem is solved by providing a combination of shelving posts, crosspieces, and clamp bolts which, combined along the principles of the invention, produce a perfectly rigid, i.e., stable, shelving framework. The shelving post according to the invention is designed as a channel section, spaced-apart bores being arranged in the legs of this channel section.

The crosspiece advocated by the invention, too, has a U-shaped configuration, at the ends of which downwardly and outwardly extending slotted crosspiece holes are arranged. The clamp bolt according to the invention corresponds essentially to a split pin of known construction. It is simply formed as a short cylindrical piece of rigid material.

The shelving embodying the principles of the invention is obtained by placing the crosspiece between the legs of the shelving post in such a way that the flange thereof points downwardly. In this way, the slotted crosspiece holes in the legs of the crosspiece will lie opposite the bores in the legs of the shelving post, so that the slotted crosspiece holes extend at an angle downwardly and outwardly.

Thus, in the shelving of the invention they lie opposite the bores in the legs of the shelving post and the clamp bolt according to the invention extends through these bores and through the slotted crosspiece holes. The weight of the crosspiece causes the clamp bolt in the bores to be urged outwardly, away from the flange of the shelving post, while the crosspiece itself is pressed inwardly against the flange of the shelving post, so that the crosspiece is clamped with the shelving post, thereby assuring to a large extent the required stability in depth of the shelving.

The shelving bases are simply hung on the crosspieces. To this end, a shelving base with a retaining rim bent away outwardly and downwardly is hung from above in the channel section of a crosspiece. Advantageously, along the sides of a shelving base one rim thereof is bent away downwardly, so that the shelving base itself can take a greater load without deflecting. To give additional stability to the shelving according to the invention, two diagonal braces are placed between two shelving posts adjoining one another on one side of the shelving.

Advantageously, these diagonal braces are of such length that they reach from a particular shelving post to the crossing point in the middle between two shelving posts; thus, four diagonal braces meet at this crossing point where they can be screwed together.

In another embodiment of the invention, border strips are provided on the sides of the shelving bases to ensure that the articles piles in the shelving cannot fall out laterally. Such border strips also serve to give additional stability to the shelving according to the invention. They are hung in the shelving posts in the same manner as the crosspieces. To this end, a border strip has a boundary angle in which a boundary hole is made. Through this boundary hole extends a clamp bolt which is carried in bores of the shelving post lying opposite one another.

In still another preferred embodiment of the invention, the channel-section-shaped shelving post has at the outer ends of the legs a tubular section, more particularly a rectangular tubular section, which stabilizes the shelving post, rendering it resistant to deflection and torsion. In this embodiment of the shelving post, the bores are drilled in the tubular section (on the outside), while slotted holes extending parallel to the flange are drilled in the legs of the shelving post (on the inside). These slotted holes start at the top on the same level as the external bores, but naturally they extend farther down than the external bores. Thus, it is possible to use clamp bolts which, because they are shorter than the spacing between two external bores, can be pushed in from outside through the bores and the slotted holes together with a crosspiece and its slotted crosspiece holes, so that they drop down in the slotted holes and thus are no longer visible from outside. This results in a better appearance of the shelving of the invention and prevents a clamp bolt from loosening because of oversight or neglect.

Preferably, the slotted hole is staggered with respect to the bore and the slotted crosspiece hole is staggered with respect to the slotted hole in the direction of fall of the clamp bolt. The direction of fall of the clamp bolt is that direction which the clamp bolt would take in a free fall if it were not stopped by the erected shelving post. This direction of fall coincides with the loading direction of the crosspieces and of the shelving bases. Because the slotted hole is staggered with respect to the bore, a clamp bolt sloipping to the lower edge of the slotted hole is prevented from laterally leaving the bores on its own accord. This is all the more true, since the slotted crosspiece hole is also staggered with respect to the slotted hole in the direction of fall; the slotted crosspiece hole thus presses the clamp bolt toward its direction of fall in the case of rectangularly shaped slotted holes or bores or slotted crosspiece holes extending obliquely of the direction of fall, depending on their inclination toward one side.

In another preferred embodiment, the notch in the cross-piece is extended over the angular rim into the side of the crosspiece, on the edge of which is placed the supporting tongue which is disposed on the shelving-base rim bent away from the shelving base adjoining the retaining rim. Thus, this supporting tongue finds the outer end of the bent-away shelving-base rim adjoining the retaining rim. This supporting tongue lies on the side wall of the crosspiece. It carries the weight of the shelving base. In this way, the gravity of the shelving base—because the former deflects the latter—is prevented from being absorbed by the retaining rim as a tensile force against the angular rim. Like the shelving-base rim, the supporting tongue is bent away downwardly. Thus, the supporting tongue together with the shelving base, is a structure which is resistant to buckling or bending, and can be loaded as a rigid beam.

According to a particularly preferred embodiment, a gusset plate is placed at the nodal point formed by a shelving post, a crosspiece, a shelving base according to the invention. The object of this gusset plate is to stabilize—with resistance to torsion—the position of the shelving post relative to the shelving base in the plane formed by these two components, and to positively connect the same. In this way, the shelving of the invention can achieve lateral stability, including stability in depth, without the use of cross braces. To this end, the upper and lower slots are made on the open side of the shelving post in the tubular section adjacent to the slotted holes and to the bores. Moreover, retaining-head bores adjacent to the supporting edge are made in the rims of the shelving base. The upper slots, the lower slots, and the retaining-head bores are locating holes for corresponding parts of the gusset plate of the invention, viz. the upper tongue, the lower tongue, and the retaining heads of the gusset plate. To this end, there are placed in the upper slot the upper tongue, in the lower slot the lower tongue, and in the retaining-head bores the retaining heads of a gusset plate. In principle, the gusset plate is a two-dimensional fill-up of the triangular region in the angle between a shelving post and a shelving base. The gusset plate of the invention is anchored by means of a pawl against the inner rim of the shelving base bent away inwardly and upwardly toward the shelving base. The retaining heads in the retaining-head bores and the upper tongue in the upper slot do not afford a reliable support to the gusset plate that in time it will work itself out of these locating holes in the shelving post and shelving base. The pawl is particularly designed as a spring disposed on the inner-rim reinforcing seam of the gusset plate, which spring protrudes with its tip through the spring slot into the duct of the inner-rim reinforcing seam.

The exact formation of a gusset plate embodying the principles of the invention will now be discussed with reference to a figure. The gusset plate principle is known, but only as a screwed gusset plate.

Instead of such a single gusset plate, a double gusset plate placed with its lower tongue in the lower slots in the tubular section of the shelving post may also be employed, the upper stabilization tongue and the lower stabilization tongue of the double gusset plate being placed in the duct of the shelving post. The duct of the shelving post is understood to be the interior of the channel-section-shaped shelving post of the invention. The double gusset plate will be detailed below with reference to a figure. It offers a still greater stabilization effect than a single gusset plate particularly since it rigidly couples two nodal points together. In addition, the upper stabilization tongue and the lower stabilization tongue in the duct of the shelving post force the latter to maintain the inner width of the duct or inner space, as the case may be. In this way, the channel-section-shaped shelving post is prevented from causing changes of form which would cause the legs of the shelving post to be compressed inwardly.

It is conceivable that such an upper stabilization tongue and a lower stabilization tongue are formed on a single gusset plate in order to accomplish the same purpose.

BRIEF DESCRIPTION OF THE DRAWINGS

The preferred embodiments of the shelving according to the invention are shown in the drawing, wherein:

FIG 10 is a cross section of a shelving post according to the invention in which are shown schematically a crosspiece and a clamp bolt, a cross brace being placed in the shelving post for purposes of stabilization;

FIG. 11 is a side view of the arrangement of FIG. 10;

DESCRIPTION OF THE PREFERRED EMBODIMENT

Figure 1:
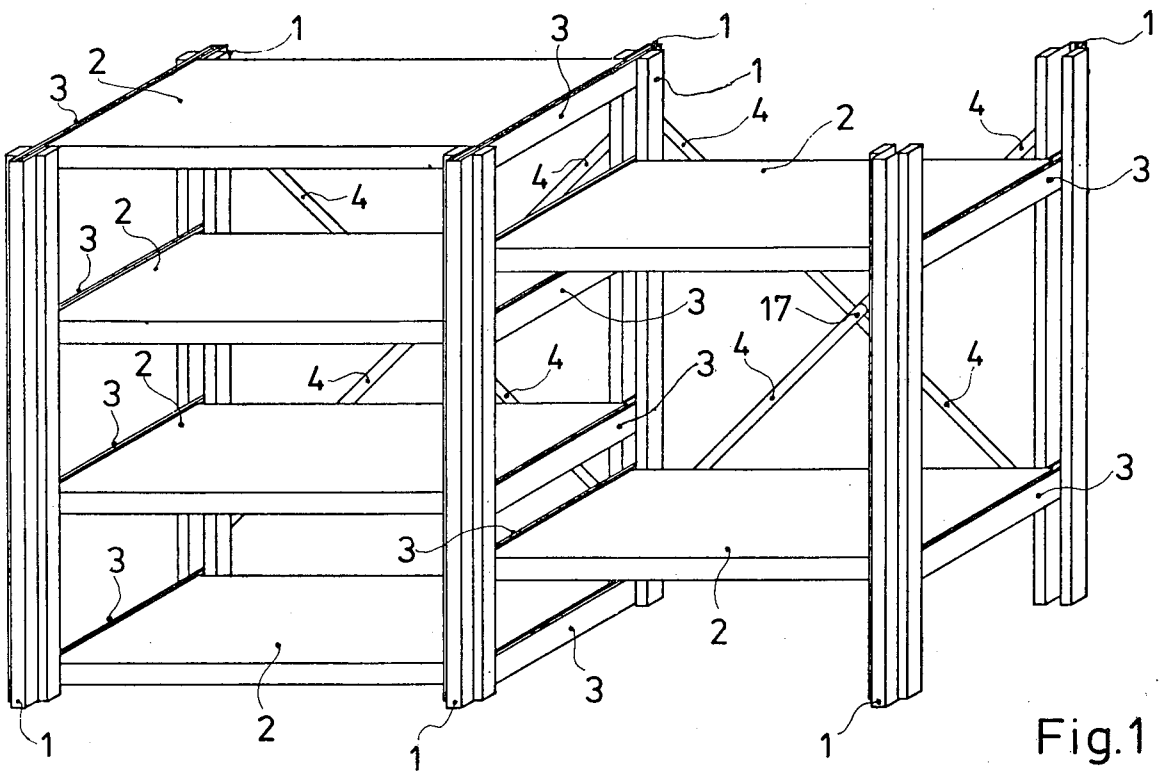
FIG. 1 is an overall perspective view of the shelf embodying the principles of the invention.

FIG. 1 is an overall perspective view of the shelving according to the invention. Reference numeral 1 denotes the shelving posts, 2 the shelving base, 3 the crosspieces, and 4 the diagonal braces. 17 is the crossing point.

Figure 2:
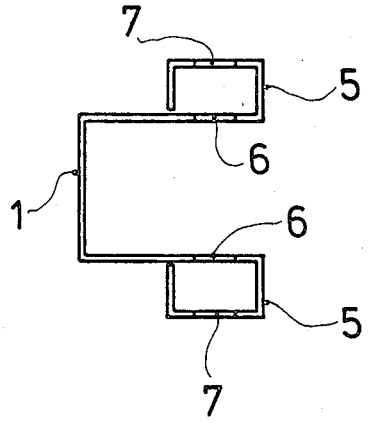
FIG. 2 is a cross section of a shelving post; tubular sections are placed at the outer ends of the legs of the shelving post.

FIG. 2 is a cross section of a shelving post according to the invention in a very stable form of construction. It is a channel-section-shaped shelving post 1 having tubular section 5 at the outer ends of the legs. In this illustration the tubular sections 5 have external bore 7, while opposite thereto, on the inside, slotted holes 6 are drilled through the legs of the shelving post 1.

Figure 3:
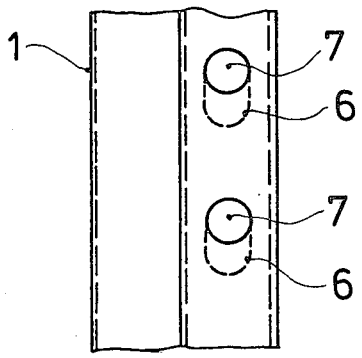
FIG. 3 is a side view of the shelving post according to FIG. 2.

This is again shown in FIG. 3 in a side view of the shelving post 1 according to the invention. The slotted holes 6 start on the same level as the bores 6, but the slotted holes 6 naturally extend further down than the bores 7.

Figure 4:
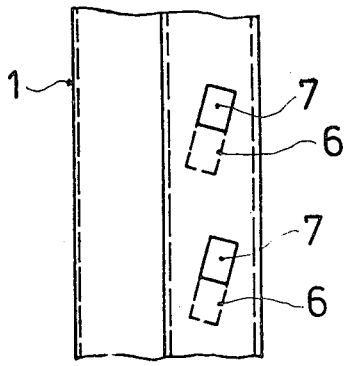
FIG. 4 is a side view of the shelving post shown in FIG. 3, but with rectangular bores and slotted holes.

FIG. 4 shows a special embodiment of the bores 7 and the slotted holes 6, in which the bores 7 and the slotted holes 6 have a rectangular shape so that a rectangular clamp bolt 8 can be inserted therethrough. The preference to rectangular clamp bolts 8 is attributable to the fact that they provide a better area load than round clamp bolts during the clamping process.

Figure 5:
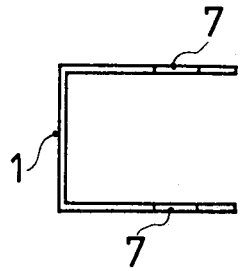
FIG. 5 is the single embodiment of a shelving post according to the invention.

FIG. 5 shows the single form of construction of the shelving post 1 of the invention. It is a conventional channel section in whose legs bores 7 are simply spaced the proper distance.

Figure 6:
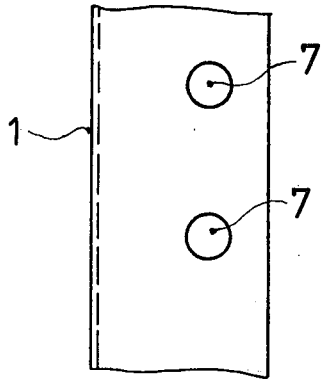
FIG. 6 is a side view of the shelving post according to the invention as shown in FIG. 5.

In FIG. 6 this is once more illustrated in a side view.

Figure 7:
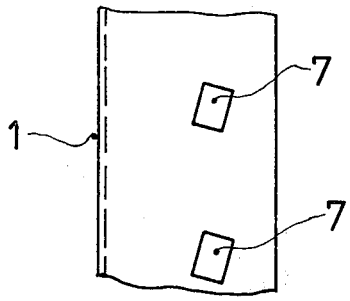
FIG. 7 is a side view of the shelving post according to the invention as shown in FIG. 6, but with rectangular bores.

FIG. 7 shows the single form of construction of FIGS. 5 and 6 of a shelving post 1 according to the invention with rectangular bores.

Figure 8:
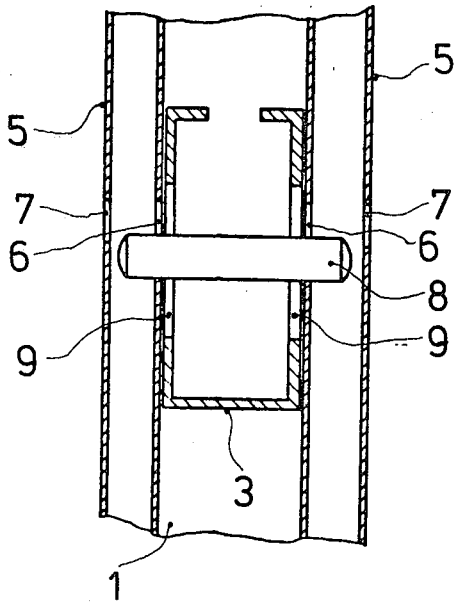
FIG. 8 is a longitudinal section showing the interoperation according to the invention between a shelving post as shown in FIG. 2, a crosspiece, and a clamp bolt.

FIG. 8 shows the interoperation according to the invention between a shelving post 1, a crosspiece 3, and a clamp bolt 8. The shelving post 1 is the post shown in FIGS. 1 and 2. The crosspiece has a substantially U-shaped configuration and slotted crosspiece holes 9 are inserted into its legs. The clamp bolt 8 is guided through these slotted crosspiece holes 9 and the slotted holes 6 of the shelving post 1. The clamp bolt is dimensioned such that it can be located on the shelving post 1 between the outer ends of the tubular section 5 without protruding from the bores 7. However, it can easily be pushed manually through these bores 7, the slotted holes 6 and the slotted crosspiece holes 9.

Figure 9:
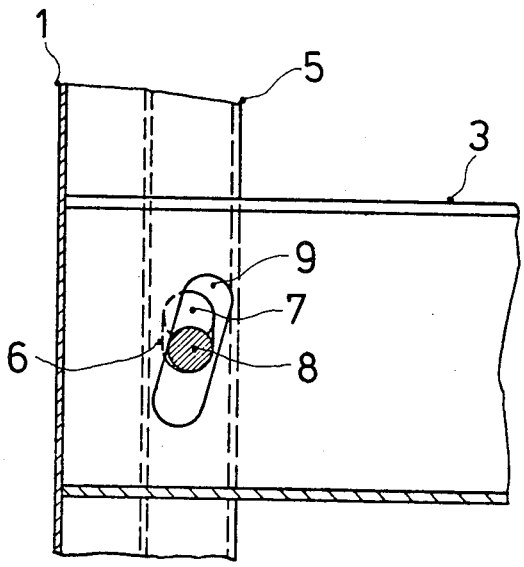
FIG. 9 is a side view of the arrangement illustrated in FIG. 8.

FIG. 9 shows clearly how the clamping effect ensuring the stabilization of the shelving according to the invention is produced. Because the slotted crosspiece holes 9 extend at an angle downwardly and outwardly, the clamp bolt 8 is urged inwardly whenever the crosspiece 3 presses downwardly. It goes without saying that this is the case if only because of the weight of the crosspiece 3. The downward pressure exerted on the clamp bolt 8 by the crosspiece and here converted into a lateral force as a result of the downwardly and outwardly extending slotted crosspiece hole 9 is increased by the weight of the shelving bottoms 2 and the objects pressing thereon. Since the clamp bolt 8 is urged inwardly, the shelving post 1 according to the invention is, of course, also urged inwardly. However, the crosspiece according to the invention is also urged outwardly, so that it is pressed against the flange of the shelving post 1 of the invention. This leads to a completely positive connection between crosspiece 3 and shelving post 1, with the result that the shelving embodying the principles of the invention is sufficiently stabilized.

Thus, compared with shelvings of known construction employing ladder-type frameworks, the shelving according to the invention has the advantage that it is made up of independent components. These independent items viz. shelving posts, crosspieces, and clamp bolts can be sold in manageable quantities so that the buyer can purchase only as many parts at an advantageous price as he needs for his shelving.

In FIG. 10 is shown how a diagonal brace 4 is hung in the shelving post 1. To this end, the shelving post has a slot 19 in one leg; the plane diagonal brace 4 can be inserted into this slot 19.

FIG. 11 shows the insertion of the diagonal brace 4 into the slot 19 of the shelving post 1 and the suspension thereat with the hook 20. The hook 20 prevents the diagonal brace 4 from being pulled diagonally out of the slot 19.

Figure 12:
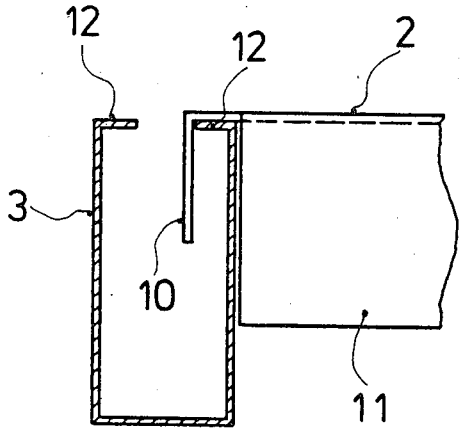
FIG. 12 is a cross section of a crosspiece according to the invention, in which a shelving base is hung.

FIG. 12 shows in cross section the interoperation between a crosspiece 3 and a shelving bottom 2. At the outer ends of its legs, the crosspiece 3 has angular rims 12 which are bent away inwardly. Over these angular rims 12 is placed the lateral retaining rim 10 of the shelving bottom 2 which is bent away outwardly and downwardly. Preferably, the shelving bottom 2 also has a rim 11 which is bent away downwardly on the side, so that the shelving bottom 2 can take a heavy load without deflecting.

Figure 13:
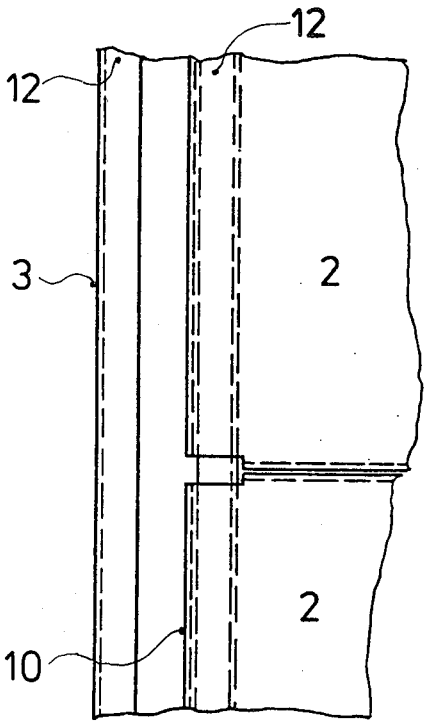
FIG. 13 is a plan view of the arrangement shown in FIG. 12 illustrating the side-by-side arrangement of a plurality of shelving bases.

FIG. 13 is a plan view of the arrangement shown in FIG. 12. It will be noted that two juxtaposed shelving bottoms 2 are placed on the crosspiece 3.

Figure 14:
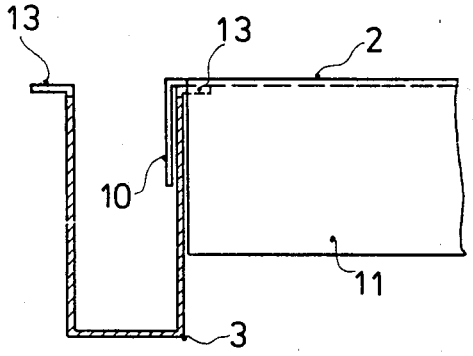
FIG. 14 shows a crosspiece, but unlike that shown in FIG. 11, this one has lateral rims bent away outwardly over which a shelving base is hung.

FIG. 14 shows another embodiment of a crosspiece 3 according to the invention. In this case, the crosspiece 3 has at the outer end of its legs lateral rims 13 which are bent away outwardly, in contradistinction to the angular rims 12 of a crosspiece which are bent away inwardly, as shown in FIG. 12. Accordingly, the retaining rim 10 of a shelving base 2 should be bent away outwardly less far than in the case of a crosspiece 3 having annular rims 12 which are bent away inwardly. The advantage of this form of construction over that shown in FIG. 12 is that the lateral rims 13 extend beyond the end of the walls 11 of the shelving base and, thus, transmit to the crosspiece 3 the load of the shelving base without significant stress of the retaining rim 10.

Figure 15:
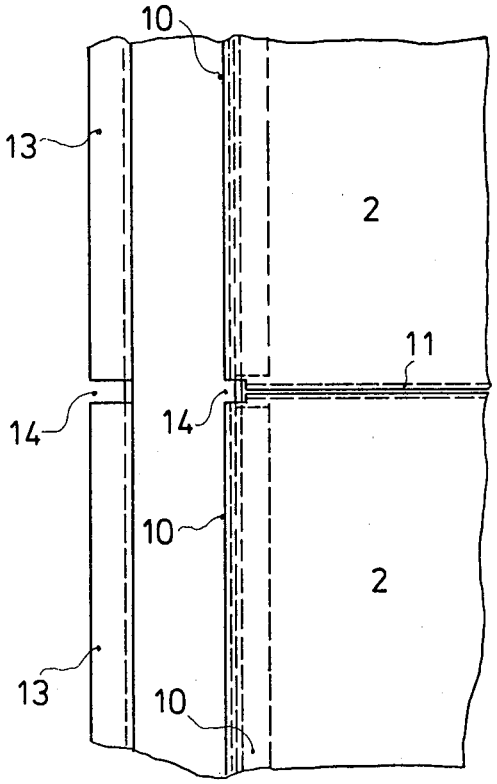
FIG. 15 shows the arrangement of FIG. 14, in which two shelving bases are placed side-by-side.

FIG. 15 shows that even in the case of a crosspiece 3 with lateral rims 13 which are bent away outwardly, two or more shelving bases 2 may be placed side by side, the crosspiece having notches 14 in the distance of the depth of the shelving base.

Figure 16:
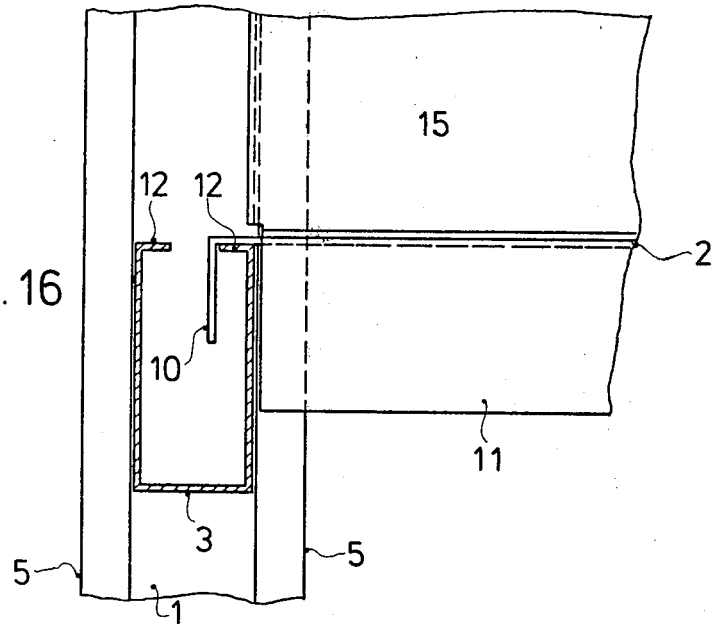
FIG. 16 is a cross section of a shelving base according to the invention with crosspiece and shelving post, over which a border strip is placed in the shelving base.
Figure 17:
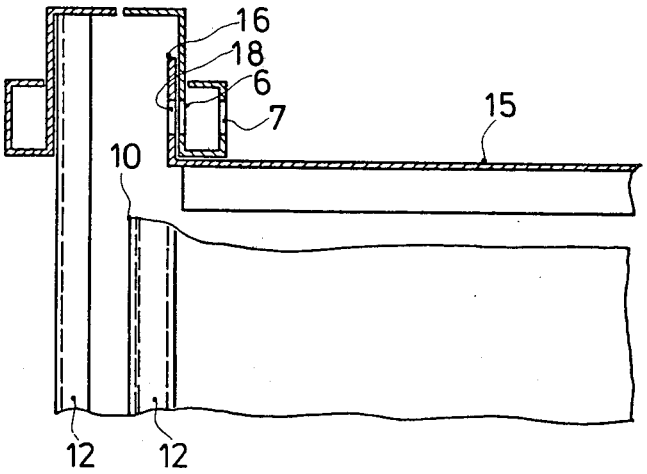
FIG. 17 is a cross section of the arrangement shown in FIG. 16.

FIG. 16 is a side view of the arrangement of a border strip 15 over the shelving base 2. This border strip 15 is provided to prevent objects on the shelving base 2 from falling from the shelving. Preferably, the border strip consists of a metal sheet, at the ends of which boundary angles 16 are bent away, as shown in FIG. 17. Into these boundary angles 16 is inserted a border strip 18 through which a clamp bolt 8 can be inserted, or a connection can be established through the boundary hole 18, the slotted hole 6, and the bore 7 so that this boundary strip 15 is fixedly anchored to the shelving post. However, neither the clamp bolt nor the screw are shown in FIG. 17.

Figure 18:
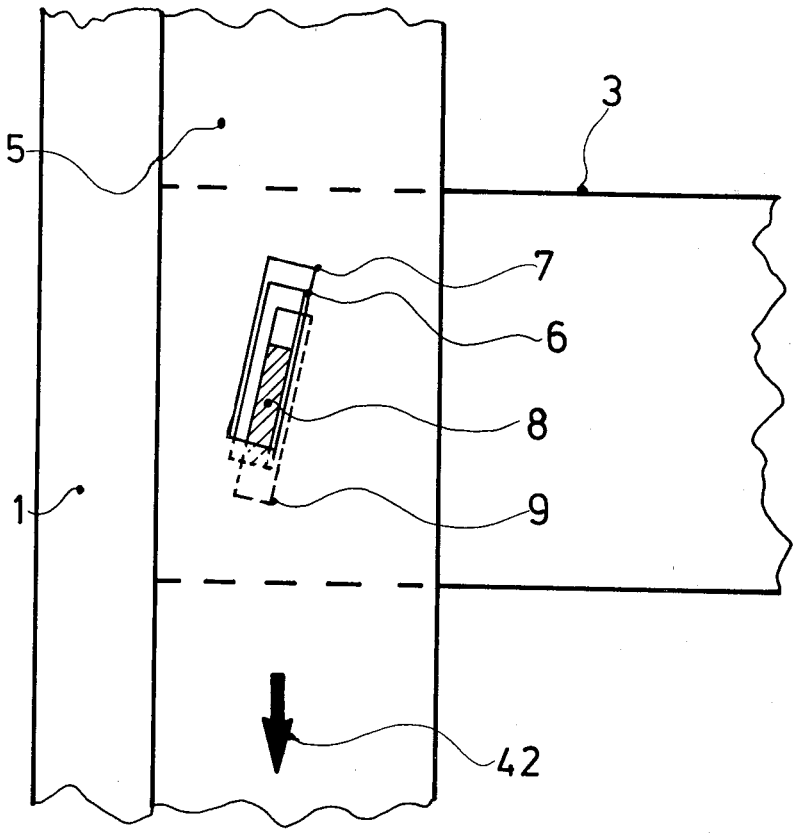
FIG. 18 is a side view of the staggered locating holes in a shelving post and a crosspiece.

FIG. 18 shows the staggering of the slotted hole 6 with respect to the bore 7 in the direction of fall 42 of the clamp bolt 8, the direction of fall 42 being that direction which would be taken by the clamp bolt 8 in a free fall if it were not stopped by the shelving post 1 or by the crosspiece 3, as the case may be. The slotted crosspiece hole 9 is made in the center of the crosspiece 3. In a free fall, the clamp bolt always reaches the lower edge, i.e., the edge lying in the direction of the direction of fall 42, of the slotted hole 6, and remains there. The bore 7 is staggered upwardly with respect to the slotted hole 6, i.e., opposed to the direction of fall 42, so that displacement of the clamp bolt 8 in its axial direction is not possible. The slotted crosspiece hole 9 is staggered with respect to the slotted hole 6 in the direction of fall 42 of the clamp bolt 8. When, as shown in the drawing, the slotted hole 6 with its bottom rim, i.e., the rim situated in the direction of the direction of fall 42, lies slightly below the lower rim of the bore 7, the clamp bolt 8 is not able to work itself out of the shelving post 1 or the tubular section 5 through the bore 7 on its own accord. For this purpose, the clamp bolt 8 is made shorter than is appropriate to the inner spacing between the two bores 7. If, nevertheless, it is desired to maneuver the clamp bolt 8 out through the bores 7, the crosspiece 3 shall be lifted against the direction of fall. In this case, the lower rim of the slotted crosspiece hole 9 in the crosspiece 3 carries the clamp bolt 8 upwardly beyond the lower rim of the bore 7. It is not absolutely indispensable to stagger the slotted crosspiece hole 9 with respect to the slotted hole 6 in the direction of fall 42 of the clamp bolt 8; it also suffices to place it at the same level as the slotted hole 6. However, it is useful to slightly stagger the slotted crosspiece hole 9 with respect to the slotted hole 6 in the direction of fall 42 of the clamp bolt 8. In this way, the user allows himself some leeway when combining the crosspiece 3 with the shelving post 1 with the aid of a clamp bolt 8. The clamp path of the clamp bolt 8 in the slotted crosspiece hole 9 is chosen such that the clamping in each case has already occurred before the clamp bolt 8 has reached the upper edge of the slotted crosspiece hole, i.e., that edge of the slotted hole situated at the end of the slotted hole 9 opposed to the direction of fall.

Figure 19:
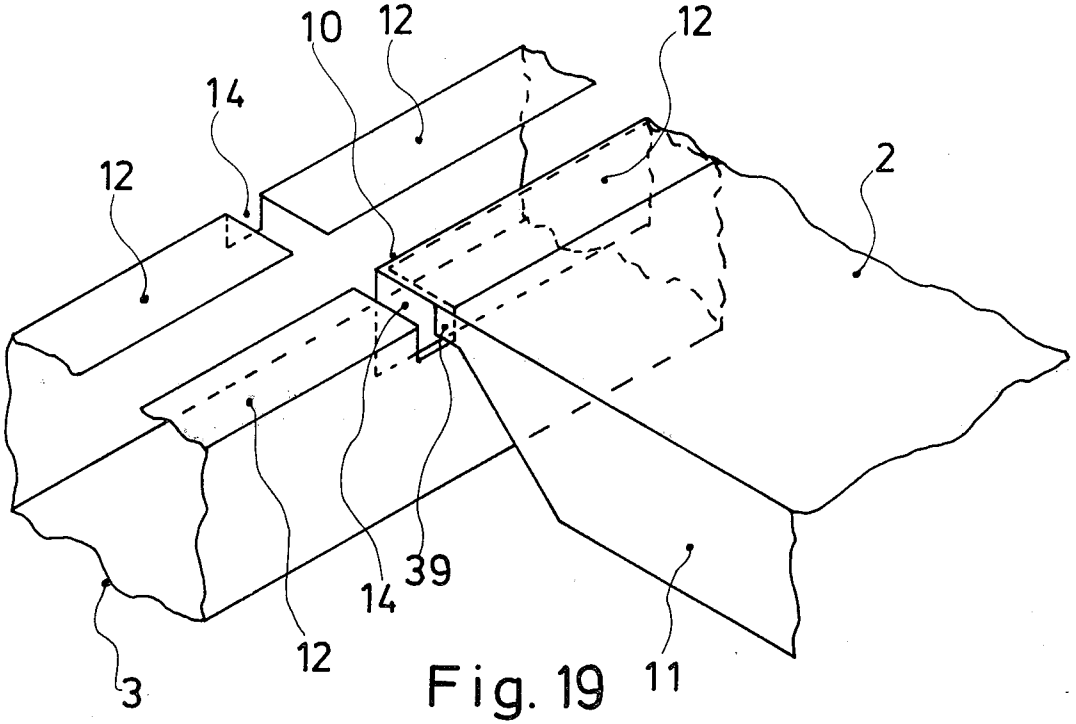
FIG. 19 is a perspective view of a shelving base strengthened by a supporting tongue for bearing purposes.

FIG. 19 is a perspective view of a shelving base 2 strengthened by a supporting tongue 39 and resting therewith on the edge of one side in the notch 14 of the crosspiece 3. For this purpose, the shelving bottom 2 is bent away laterally downwardly toward a rim 11 of the shelving base. At the outer end of the shelving base 2, this rim 11 runs out in a narrow supporting tongue 39. The outer end of the shelving base 2 itself may be formed by a retaining rim 10; this retaining rim 10 is flung over the angular rim 12 of a crosspiece 3. The actual weight of the shelving base 2 is carried by the supporting tongue 39. Hence, the retaining rim 10 is relieved of tensile forces. These tensile forces may result from the deflection of the loaded shelving base 2; thus, the latter appears to be shortened, so that the retaining rim 10 is pulled against the angular rim 12. The downward-bent construction of the supporting tongue 39 and of the shelving-base rim 11 confers upon the shelving base 2 the rigidity of a mechanically rigid beam.

Figure 20:
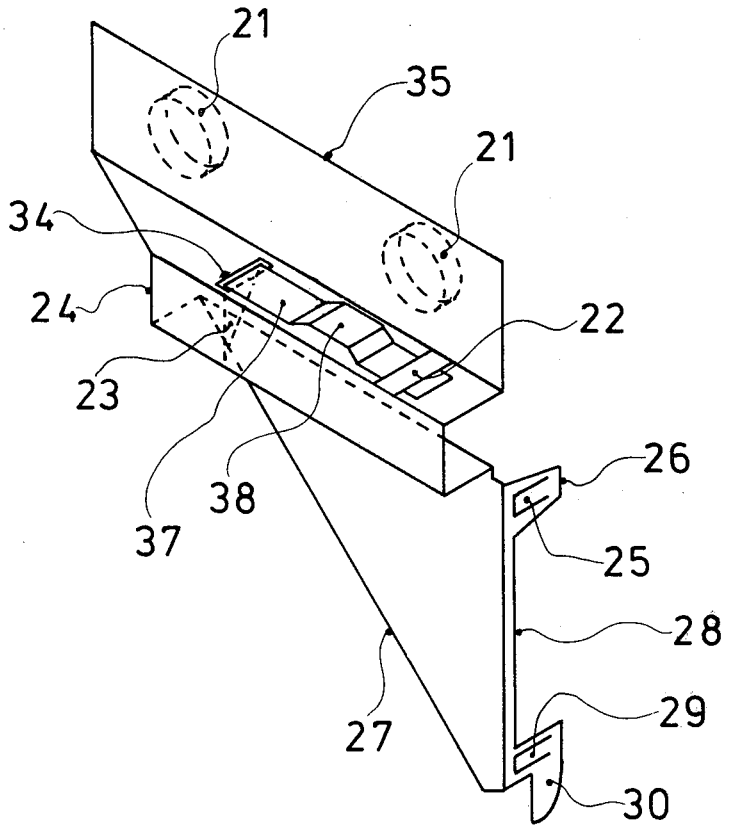
FIG. 20 is a perspective view of a gusset plate according to the invention.

FIG. 20 is a perspective view of the gusset plate embodying the principles of the invention. Such a gusset plate is basically a simple two-dimensional metal sheet having a triangular configuration. However, the gusset plate of the invention is not fully two-dimensional. Rather, it has on the side parallel to one side of the right angle an inner-rim reinforcing seam 24. This inner-rim reinforcing seam gives a U-shaped profile to this region of the gusset plate. The gusset plate region extending between the inner-rim reinforcing seam 24 and the leg side of the right angle is denoted as plate 35. Retaining heads 21 are placed on this plate 35. These retaining heads 21 protrude from the plate 35 in the direction opposed to the convexity of the inner-rim reinforcing seam 24. The retaining heads 21 may be pulled from the plane in a manner in itself known. The metal sheet located between the other leg and the long side of the triangular gusset plate is referred to as angle plate 27. The leg of the right angle placed on this plate 27 is particularly provided with a supporting edge 28; this edge of the angle plate 27 is shaped toward the side of the retaining heads 21. To extend this supporting edge 28 there are placed against the inner-rim reinforcing seam 28 an upper tongue 26 and at the more remote end of this leg side the lower tongue 30. The upper tongue 26 carries an upper reinforcing seam 25 and the lower tongue 30 carries a lower reinforcing seam 29, the purpose of which will be explained with reference to the following figures. The inner-rim reinforcing seam serves to carry the shelving-base rim 11 which is bent away inwardly and upwardly, i.e., toward the shelving base 2 itself. This will be explained with reference to the figures below. On the side of the inner-rim reinforcing seam adjacent to the retaining heads 21 a spring 37 is provided as a pawl. Spring 37 is held in position at one of its ends by a securing clip 22. The other end of the spring 37 is formed as a tip 23. This tip 23 is bent away at right angles to spring 37. The tip 23 protrudes through the spring slot 34 into the duct of the inner-rim reinforcing seam 24. The edge of the tip 23 adjacent to the back of the inner-rim reinforcing seam is designed such as to run parallel to the back of the inner-rim reinforcing seam 24. The spring 37 has a tension bracket 38 between the securing clip 22 and the spring slot 34. At this point, the spring 37 is bent away from the side of the inner-rim reinforcing seam 24 on which the spring 37 is disposed. By means of this tension bracket 38 it is possible to lift the spring 37, e.g., with the aid of a screwdriver.

Figure 21:
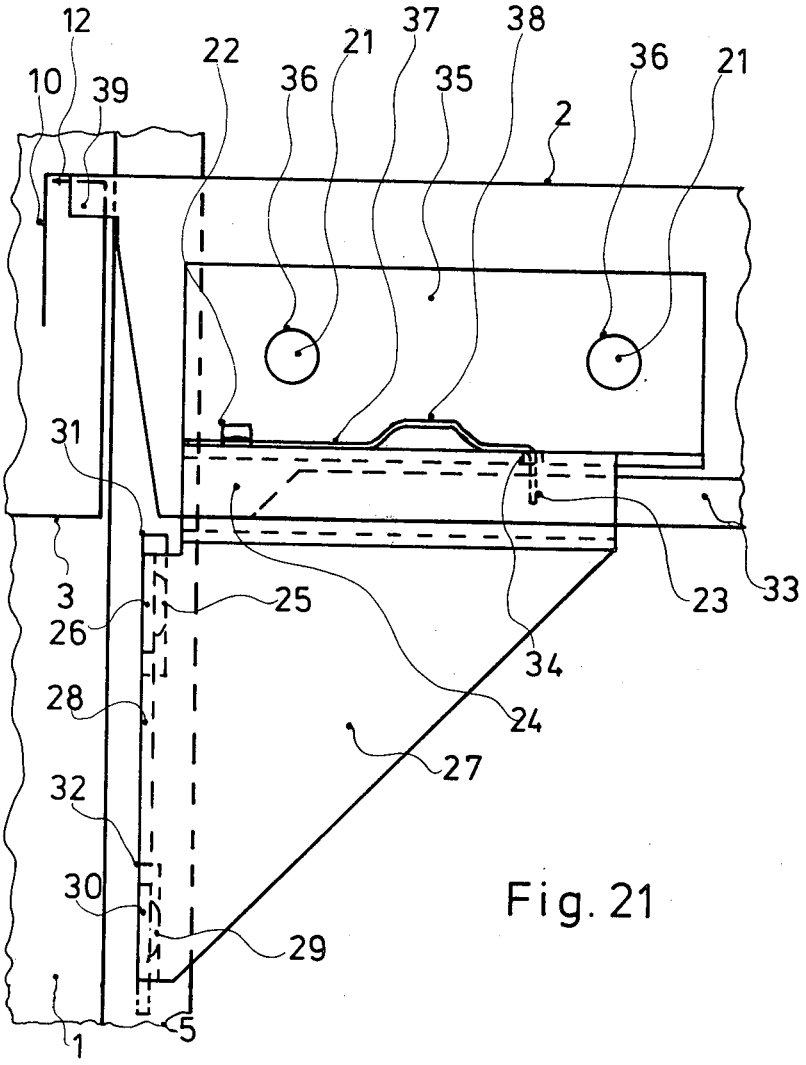
FIG. 21 is a front view of a gusset plate inserted into a shelving base and a shelving post.

FIG. 21 is a front view of a gusset plate according to the invention inserted into a shelving base 2 and a shelving post 1. The observe is looking at the side of the gusset plate provided with the convexity of the inner-rim reinforcing seam. He is also looking in the direction of the interior of the shelving post 1 and from the inside to the downwardly-bent-away edge 11 of the shelving base 2. The upper reinforcing seam 26 of the gusset plate is inserted into the upper slot 31 in the tubular section 5. The upper slot 31 is made slightly wider than is appropriate to the thickness of the upper reinforcing seam 26. This clearance is filled up by an upper reinforcing seam 25. To this end, the upper reinforcing seam 25 tapers off to the end of the front reinforcing seam. Thus, this upper reinforcing seam 26 can be inserted with clearance into the upper slot 31. The lower reinforcing seam 30 is inserted into the lower slot 32. Here, too, the clearance of the lower reinforcing seam in the wider lower slot 32 is filled up by the lower reinforcing seam 29. The lower reinforcing seam 29 also tapers off to the end of the front reinforcing seam of the lower reinforcing seam 30. In the duct or the interior of the channel-section-shaped shelving post 1 the crosspiece 3 is adjacent to the upper reinforcing seam 26. Because of the chosen line of vision, it can only be seen in cross section. The shelving base 2 rests with the supporting reinforcing seam 39 on the crosspiece 3. Not shown in the figure is the notch 14 which extends into the side of the crosspiece 3. The supporting reinforcing seam 39 rests on the edge of this notch 14. The retaining rim 10 of the shelving base 2 lies above the angular rim 10 of the crosspiece 3. The retaining heads 21 of the gusset plate according to the invention are placed in the retaining-head bores 36 of the shelving base 2. In the figure, the retaining-head bores 36 are not shown in detail. These retaining-head bores 36 are inserted into the shelving-base rim 11 which is bent away downwardly. At its lower edge, the shelving-base rim 11 is bent away inwardly and upwardly to form an inner rim 33. This is clearly shown in the following FIG. 22. Facing inward, i.e., in the line of vision, or emerging from the drawing surface, the inner-rim reinforcing seam 24 of the gusset plate according to the invention exhibits a convexity. Thus, the inner rim 33 is provided with a clearance. The tip 23 of the spring 37 acts as a pawl against the inner rim 33, preventing the gusset plate from dropping out of the retaining-head bores 36 and the upper slot 31. When the gusset plate is to be taken out, the spring 37, for example, with a screwdriver, must be lifted so far that, by virtue of the tension clip 38, the tip 23 uncovers the inner rim 33 of the shelving base 2. The gusset plate can then be taken out very easily.

Figure 22:
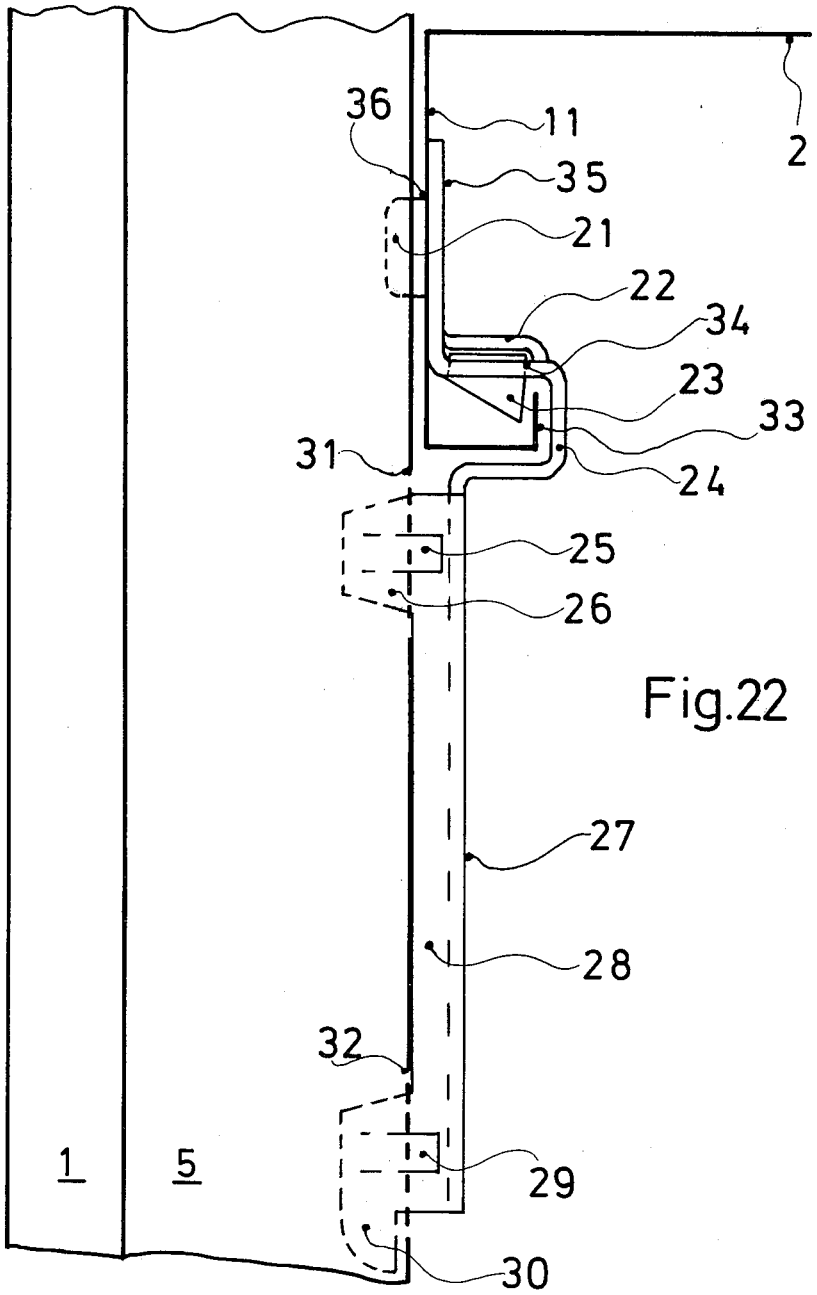
FIG. 22 is a side view of a gusset plate inserted into a shelving base and a shelving post.

FIG. 22 is a side view of the gusset plate according to the invention inserted into a shelving post 1 and a shelving base 2. The line of vision is directed toward the supporting edge 28 in the plane of the angle plate 27 or of the plate 35. Clearly visible is the inner rim 33 which is bent away inwardly and upwardly toward the shelving base 2. Also shown clearly is the action of the tip 23 against the inner rim 33, using one of its edges as a pawl. For this purpose, the edge of the tip 23 of the spring 37 adjacent to the back of the inner-rim reinforcing seam 24 is designed such as to run parallel to the inner rim 33. According to the embodiment shown, this is also assured because the edge in question runs parallel to the back of the inner-rim reinforcing seam 24, since this back, in turn, runs parallel to the portion of the inner rim 33 which is bent away upwardly. The retaining heads 21 rest in the retaining-head bores 36 in the shelving-base rim 11. On the inside, the plate 35 bears against the shelving-base rim 11. As already discussed with reference to FIG. 21, the upper reinforcing seam 26 rests in the upper slot 31, and the lower reinforcing seam 30 rests in the lower slot 32. The upper slot 31 is longer than the upper reinforcing seam 26 and the lower slot 32 is longer than the lower reinforcing seam 30. In this way, both the upper reinforcing seam 26 and the lower reinforcing seam 30 have a clearance in the longitudinal direction of the shelving post 1. This is useful because the height of the shelving base 2, due to the vertical adjustability of the crosspiece 3, is not accurately determined. This is well-grounded in the clamp bolt principle of the shelving according to the invention. The supporting edge 28 serves to strengthen the angle plate 27. It bears from outside against the channel section 5.

Figure 23:
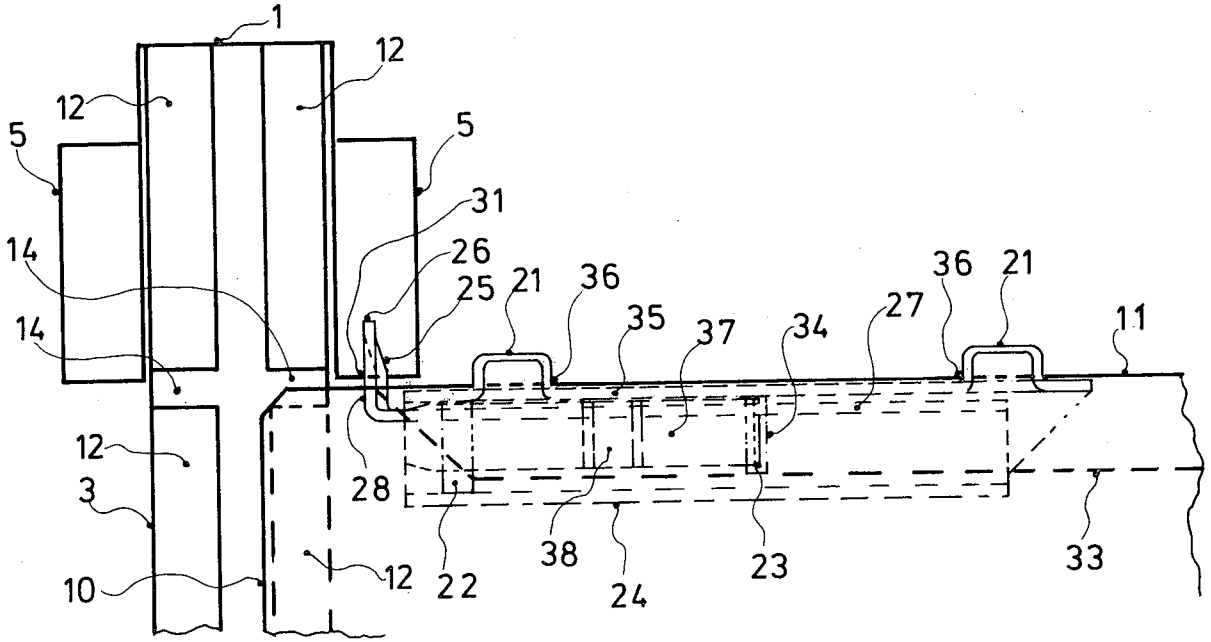
FIG. 23 is a plan view of a gusset plate inserted into a shelving post and a shelving base.

FIG. 23 is a plan view of the gusset plate according to the invention after insertion into a shelving post 1 and a shelving base 2. The spring 37 is fixed on the side of the inner-rim reinforcing seam 24 adjacent to the retaining heads 21 by means of securing clip 22. It goes without saying that any other type of fastening, e.g., riveting, may also be considered. The tension clip 38 is not clearly visible because of the perspective position chosen. Instead, the spring slot 34 can be seen clearly. The tip 23, bent away from the spring 37, is arranged in this spring slot 34. The tip 23 enters the interior of the inner-rim reinforcing seam 24, i.e., behind the chosen drawing surface of FIG. 23, through the spring slot 34.

Figure 24:
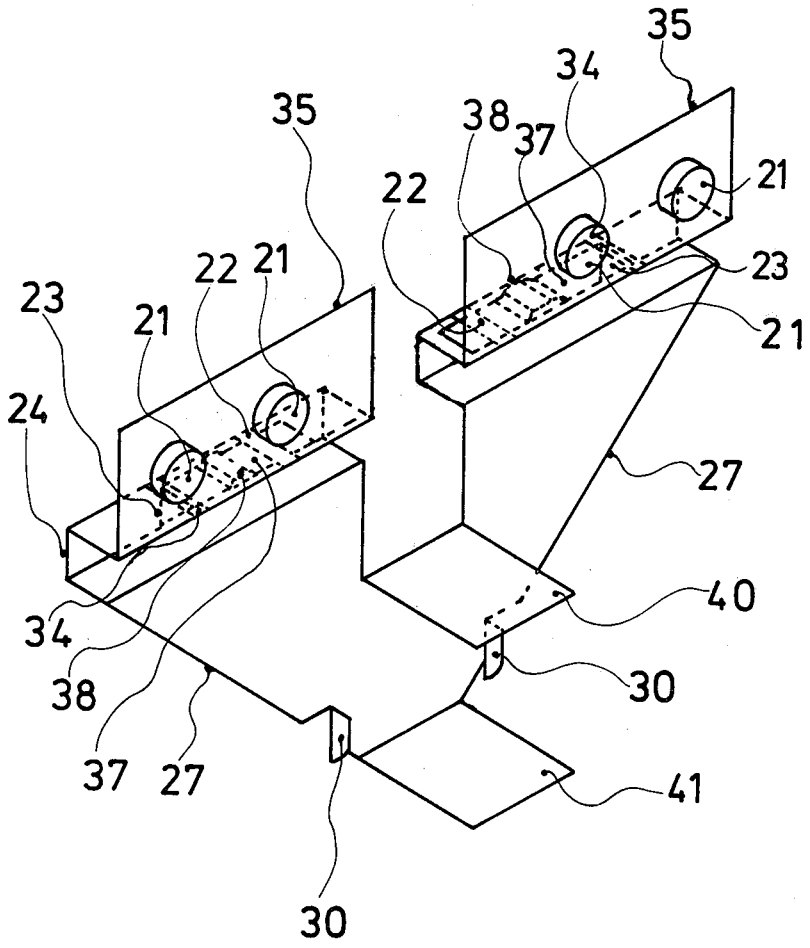
FIG. 24 is a perspective view of a double gusset plate according to the invention.

FIG. 24 shows a double gusset plate according to the invention. In principle, it is the joining of two single gusset plates as shown in FIG. 20. However, a double gusset plate has between the angle plate 27 in the direction of the retaining heads 21 protruding stabilization elements for the interior or the duct of a channel-section-shaped shelving post 1 according to the invention. As shown in FIG. 24, these are the upper stabilization reinforcing seam 40 and the lower stabilization reinforcing seam 41. Between the upper stabilization reinforcing seam 40 and the plates 35 a free space is left in which is situated the crosspiece 3 in the shelving post 1 after insertion of the double gusset plate. Thus, the upper stabilization reinforcing seam 40 and the lower stabilization reinforcing seam 41 are disposed in the interior of the channel-section-shaped shelving post 1. The lower reinforcing seams 30 are placed in the lower slots 32. In some cases the double gusset plate according to the invention has a corresponding lock-bead instead of the supporting edge 28. Sometimes the double gusset plate may also have upper reinforcing seam 26 for insertion into the upper slots 31. Otherwise the double gusset plate is provided like a single gusset plate with inner-rim reinforcing seam 24, as well as with a spring 37 acting as a pawl.

Advantages of the shelving according to the invention: It is a shelving built according to the unit construction system which can be mounted by anybody without the use of special tools, because a clamp bolt can be manually inserted through the bores, slotted holes, and slotted crosspiece holes. The buyer can purchase exactly as many shelving elements (shelving posts, crosspieces, shelving bases and, if necessary, diagonal braces and border strips) as he needs for the shelving of the size he desires. Finally, he can extend at will a preassembled shelving by making additional purchases of these shelving components. It stands to reason that the sale of a shelving according to the unit construction system is very convenient, since the single items can be sold independently, with considerable saving in space.

The shelving according to the invention does not even need cross braces. Stabilization in depth of the shelving according to the invention can also be achieved by means of a gusset plate or a double gusset plate according to the invention or by diagonal braces. These gusset plates or double gusset plates can also be inserted manually without the use of any tools. They confer upon the shelving a reliable rigidity with stabilization in depth, which could not be surpassed even by a screwed gusset plate having the same diemensions.

Thus, a shelving is provided which can be assembled without the aid of any tools and which is completely stable. The shelving according to the invention can be dismantled just as easily as it can be assembled.

LEGEND 1. shelving post
2. shelving base
3. crosspiece
4. diagonal brace
5. tubular section
6. slotted hole
7. bore (hole)
8. clamp bolt
9. slotted crosspiece hole
10. retaining rim
11. shelving-base rim
12. angular (or angle) rim
13. lateral rim
14. notch, recess
15. border strip
16. boundary angle
17. crossing point
18. boundary hole
19. slot
20. hook
21. retaining head
22. retaining clip
23. tip
24. inner-rim bead
25. upper bead
26. upper tongue
27. angle plate
28. supporting edge
29. lower bead
30. lower tongue
31. upper slot
32. lower slot
33. inner rim
34. spring slot
35. plate
36. retaining-head hole
37. spring
38. tension clip
39. supporting tongue
40. upper stabilization tongue
41. lower stabilization tongue
42. direction of all

I claim:

1. Erectable shelving comprising shelving posts, crosspieces, shelving bases, and clamp bolts, wherein said shelving posts each have channel-section-shaped legs and bores are drilled in the legs of the channel-section-shaped shelving posts, between the legs of at least two shelving posts there is placed a crosspiece, said crosspiece being of channel-section-shaped cross-section and having obliquely downwardly and outwardly extending slotted crosspiece holes lying opposite the bores in said legs, a clamp bolt being placed in the bores and in the slotted cross-piece holes, said bores and said slotted crosspiece holes lying opposite one another, and each of the channel-section-shaped shelving posts has at the outer ends of its legs a tubular section provided on the outside with bores and on the inside with slotted holes extending parallel to the flange in the legs.

2. The shelving according to claim 1, characterized in that a clamp bolt is placed in the slotted holes and in the slotted crosspiece holes lying opposite thereto for force locking the shelving post and crosspiece together.

3. The shelving according to claim 1 or 2, characterized in that the bores and the slotted holes, as well as the slotted crosspiece holes, have a rectangular configuration.

4. The shelving according to claim 2 characterized in that each shelving base has provided therewith retaining rims, and a shelving base is placed with a retaining rim, which is bent away outwardly and downwardly, in the crosspiece.

5. The shelving according to claim 4, characterized in that the shelving base has a lateral rim which is bent away downwardly.

6. The shelving according to claim 1 or 2, characterized in that the crosspiece has at the outer ends of its legs an angular rim which is bent inwardly.

7. The shelving according to claim 1, or 2, characterized in that the crosspiece has at the outer ends of its legs lateral rims which are bent outwardly.

8. The shelving according to claim 1, or 2, characterized in that there are juxtaposed in a cross-piece a plurality of shelving bases spaced the proper distance from one another via a notch along their retaining rims.

9. The shelving according to claim 1, or 2, characterized in that two diagonal braces are placed between two shelving posts adjoining one another on one side of the shelving as erected.

10. The shelving according to claim 9, characterized in that the diagonal braces extend from a particular shelving post to the crossing point.

11. The shelving according to claim 4, characterized in that there is placed on a shelving base, bearing directly from above, a border strip, the boundary angle of which lies on the inside of one leg of the shelving post and a clamp bolt extends through the boundary hole in bores and/or slotted holes lying opposite one another.

12. The shelving according to claim 1 or 2, characterized in that the slotted hole is staggered with respect to the bore and the slotted crosspiece hole is staggered with respect to the slotted hole in the direction of fall of the clamp bolt.

13. The shelving according to claim 8, characterized in that the notch extends via the angular rim into the side of the crosspiece, on the edge of which is placed the supporting tongue which is disposed on the shelving-base rim bent away from the shelving base adjacent to the retaining rim.

14. The shelving according to claim 1, or 2, characterized in that there are arranged:

(a) on the open side of each of the shelving posts in the tubular sections and adjacent to the slotted holes and to the bores therein, upper slots and lower slots;

(b) each shelving base having shelving-base rims, retaining rims and retaining-head bores;

(c) an upper slot with an upper tongue therein, and a lower slot with a lower tongue therein and in the retaining-head bores are retaining heads of a gusset plate which, by means of a pawl, more particularly in the shape of a spring placed on an inner-rim bead of the gusset plate and protruding with its tip through a spring slot into the duct of an inner-rim duct, is anchored against the inner rim which is bent away inwardly and upwardly toward the shelving base.

15. The shelving according to claim 14, characterized in that instead of a single gusset plate there is arranged a double gusset plate having lower tongues in the lower slots, an upper stabilization tongue and lower stabilization tongues being disposed in the duct of the shelving post.

* * * * *